United States Patent [19]

Bassett

[11] 4,235,424

[45] Nov. 25, 1980

[54] AIR COOLED ELECTRODE SYSTEM FOR ELECTRICALLY HEATED MOLTEN BATH FURNACES

[75] Inventor: Leslie Bassett, Mount Clemens, Mich.

[73] Assignee: Upton Industries, Inc., Roseville, Mich.

[21] Appl. No.: 968,065

[22] Filed: Dec. 11, 1978

[51] Int. Cl.[3] ..... C21D 1/46

[52] U.S. Cl. ..... 266/120; 266/130; 13/18 R

[58] Field of Search ..... 266/120, 128, 130; 13/6, 18 R, 23

[56] References Cited

U.S. PATENT DOCUMENTS

| | | | |
|---|---|---|---|
| 1,937,064 | 11/1933 | Moore | 13/23 |
| 2,040,215 | 5/1936 | Raua | 13/18 R |
| 2,355,761 | 8/1944 | Upton | 13/23 |
| 2,464,008 | 3/1949 | Upton | 75/11 |
| 3,049,576 | 8/1962 | Upton | 13/23 |
| 3,085,124 | 4/1963 | Upton | 13/23 |
| 3,576,385 | 4/1971 | Robinson | 13/6 |
| 3,666,870 | 5/1972 | Kemper | 13/23 |

*Primary Examiner*—L. Dewayne Rutledge
*Assistant Examiner*—John P. Sheehan
*Attorney, Agent, or Firm*—Cullen, Sloman, Cantor, Grauer, Scott & Rutherford

[57] ABSTRACT

An air cooled electrode system is employed with one or more electrically heated molten salt bath furnaces. Each furnace comprises a wall enclosing a chamber which contains the molten salt bath. Electrodes are laid or located in the wall to extend through the wall into the chamber so that each electrode exposes only one face to the molten bath. The electrodes are parallel to one another and are located on opposite sides of the chamber. Each electrode has an elongated shank made from an electrical conductive material and has in one end thereof a pair of elongated holes which extend into the shank and terminates a distance from the other end of the shank. A connecting hole extends laterally into the shank to connect the inner ends of the elongated holes. The connecting hole and elongated holes form an air cooling passage which has an entrance and an exit. The air cooled electrode system includes a blower which is connected to a header for delivering air. Conduits connect the header to the entrances to the cooling passages of the electrodes of each furnace. When the furnace(s) is in use, the blower directs air to the header which delivers the air through the conduits to the entrances to the cooling passages of the electrodes. The air is directed through the cooling passages and removes heat from the electrodes. Finally, the heated air is directed to the exit or exhaust ends of the cooling passages.

14 Claims, 4 Drawing Figures

AIR COOLED ELECTRODE SYSTEM FOR ELECTRICALLY HEATED MOLTEN BATH FURNACES

BACKGROUND OF THE PRESENT INVENTION

1. Field of the Invention

This invention relates to industrial heat treating furnaces and more particularly relates to molten salt bath furnaces of the type in which the heat is electrically generated, the molten bath constituting the resistor. Specifically, the invention relates to the use of air cooled electrodes in heat treating furnaces in place of water cooled electrodes which have been used extensively heretofore.

2. Description of the Prior Art

The prior art shows electrically heated molten salt bath furnaces which utilize water cooled electrodes. One prior art patent utilizing water cooled electrodes is the Upton U.S. Pat. No. 2,355,761 dated Aug. 15, 1944 entitled "Electrically Heated Molten Bath Furnace". The water cooled electrodes employed therein take a considerable amount of water to cool the electrodes and the cooling water, after use, is either drained to the sewer or recirculated through an expensive water recirculating system. Another problem with a water cooled electrode is that the cooling hole provided therein frequently becomes clogged or plugged due to the presence of lime or iron in the water. The minerals settle in the hole blocking the coolant passage and thereby preventing the water from circulating through the electrode. Also a water cooled electrode system employs an elaborate and expensive plumbing system which frequently fails due to ruptured pipes or hoses. Such breakage can create a safety hazard in the event the water contacts the molten salt.

SUMMARY OF THE PRESENT INVENTION

The present invention relates to an air cooled electrode system for industrial heat treating furnaces which have certain economical, design and functional advantages over water cooled electrodes previously employed as described in the expired Upton U.S. Pat. No. 2,355,761. Economical savings are achieved due to the fact that large quantities of precious water are not employed. Also it has been found by using air as the coolant that the life of the electrode is extended because the electrode stays warmer and does not have to work as hard to keep the furnace at a set temperature. In addition, with an air cooled electrode, the cooling holes in the shank of the electrode do not plug up with lime, iron or other minerals as is the case when water is used as the cooling agent. The air cooled electrodes require less maintenance than water cooled electrodes. Also no elaborate and expensive plumbing system is required as is the case with water cooled electrodes.

Thus it is a feature of the present invention to provide an electrode comprising an elongated shank made from an electrical conductive metal and having a longitudinally extending axis, with the shank having in one end thereof a pair of elongated holes which extend into the shank and terminate a distance from the other end of the shank.

A further feature of the present invention is to provide an electrode of the aforementioned type in which each hole has an axis which is spaced from and is parallel to the longitudinally extending axis, and includes a connecting hole which extends laterally into the shank to connect the inner ends of the elongated holes.

A still further feature of the present invention is to provide an electrode of the aforementioned type wherein the elongated holes and the connecting hole forms an air cooling passage having an entrance and an exit whereby when the electrode is in use air may be directed through the cooling passage to assist in removing heat generated by the electrode.

Another feature of the present invention is to provide an electrode of the aforementioned type in which the shank is of rectangular cross section; and the axes are located in the same plane, with the axes of the holes being located on opposite sides of the longitudinally extending axis.

Still another feature of the present invention is to provide an electrode of the aforementioned type wherein a pair of laterally spaced holes extend from one side of the shank to the other and through which fastening devices are adapted to extend to secure lead connections to the electrode.

A further feature of the present invention is to provide an electrically heated molten bath furnace which includes a wall enclosing a central chamber for containing the molten salt bath and with one or more electrodes extending through the wall into the chamber below the surface of the molten bath. An air blower system is provided which is connected to the entrance to the cooling passage of each electrode for directing air through the cooling passage to remove heat from the electrode and to direct the heated air to the exit.

Another feature of the present invention is to provide an electrically heated molten salt bath furnace of the aforementioned type wherein the blower system comprises a blower and a header, with the blower being connected to the header for delivering air and conduit means connecting the header to the entrances to the cooling passages of the electrodes.

Still another feature of the present invention is to provide a single air blower system which may be used with one or more heat treating furnaces.

A further feature of the present invention is to provide an air cooled electrode system which is economical to manufacture, efficient in operation, is easy to maintain and eliminates the disadvantages and expenses resulting from the use of water cooled electrodes.

DESCRIPTION OF A PREFERRED EMBODIMENT

Figure 1:
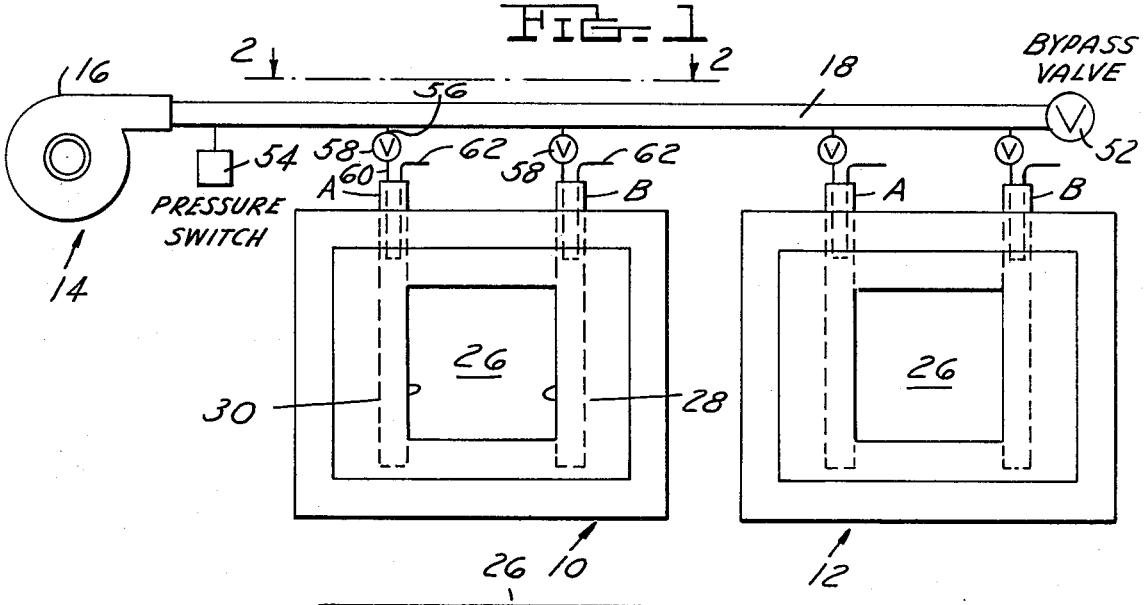
FIG. 1 is a plan view of a pair of electrically heated molten salt bath furnaces in which a single air blower and header assembly is utilized to direct air to the electrodes employed by each of the furnaces.

FIG. 1 illustrates a pair of heat treating or molten salt bath furnaces 10 and 12, each furnace being of generally identical construction. The furnaces 10 and 12 are connected to a single air cooled electrode system 14 which consists in part of a blower 16 and an elongated header 18. The air cooled electrode system 14 is constructed and arranged to supply air to the electrodes A and B of each furnace 10, 12 to circulate the air through the electrodes A and B of the furnaces 10 and 12; and to remove and thereby to exhaust the heat from the electrodes. Such method extends the life of the electrodes because the electrodes stay warmer and therefore do not have to work as hard to keep the furnaces 10 and 12 at the set or selected temperature.

It should be appreciated that the air cooled electrode system 14 may be used with one or any number of furnaces. The use of two furnaces 10 and 12 are merely for illustrative purposes.

In the past, the furnace electrodes have been cooled by water and the use of water today in many areas is economically prohibitive since the water utilized is either directed to drain or to the sewer after it is heated or an expensive water recirculating system must be employed as mentioned previously.

Each molten bath furnace 10, 12 has, as an example, a monolithic ceramic wall 20, an outer brick wall 22 and an interior refractory or brick wall 24 as is well known in the art. Typical industrial heat treating furnaces with which the present invention may be employed are shown in the following U.S. Patents assigned to the assignee of record: Nos. 2,355,761; 2,464,008; 3,049,576; 3,085,124; 3,128,327; 3,420,937; and 3,666,870.

Figure 3:
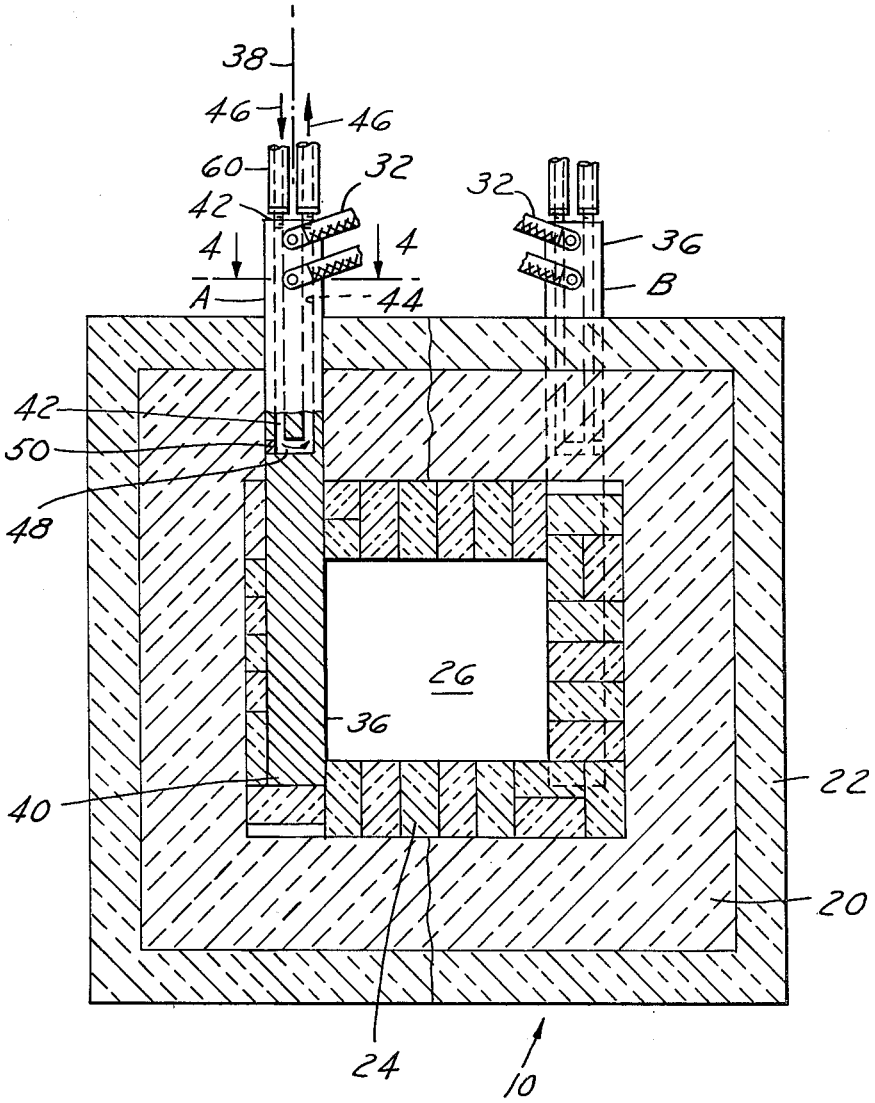
FIG. 3 is a sectional view through one of the furnaces taken on the line 3—3 of FIG. 2.

The inner refractory brick wall 24 is constructed and arranged to provide a central salt chamber 26 which is rectangular in horizontal section as best illustrated in FIG. 3. The chamber 26 has a bottom surface 27 and a pair of opposed side surfaces 28, 30.

Figure 2:
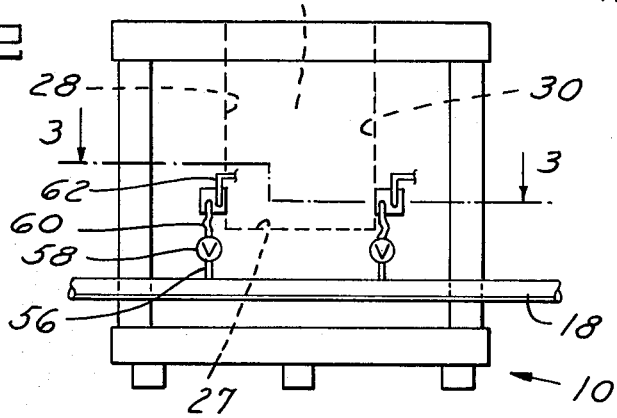
FIG. 2 is a fragmentary elevational view looking in the direction of arrows 2—2 of FIG. 1.

Each furnace 10, 12 has one or more pairs of electrodes A and B which are formed of metal and extend through the walls into the chamber 26 below the surface of the molten bath contained within the chamber 26. As specifically shown in FIGS. 1 and 3, these electrodes A and B are arranged parallel to each other with their inner faces substantially flush with the opposite inner surfaces 28, 30 of the walls of the chamber 26 and at a level above the bottom surface 27 of the chamber 26 as shown in FIG. 2. The electrodes A and B may be laid or inserted into the brick work during the building of the walls of the furnaces 10, 12 and such electrodes A and B would occupy spaces left in one tier of brick. The electrodes A and B extend outward beyond the wall 22 (FIG. 3) and their outer ends are attached by a pair of electrical conductors or lead connections 32 leading to a transformer, not shown, as is well known in the art. The electrodes A and B are appropriately sealed within the furnace brick structure so as to prevent leakage from the chamber 26 which contains the molten salt bath.

Each electrode A, B comprises an elongated shank 36 of generally rectangular cross section (FIG. 4) and which has a longitudinally extending axis 38. The shank 36 is made from an electrical conductive metal and includes an inner end 40 and an outer end 42. A pair of elongated holes 44 are provided in the outer end 42 of the shank 36 and extend part way through the shank 36, as an example a distance of eleven to fifteen inches, as best illustrated in FIG. 3. The depth of each hole 44 is determined by the type of furnace and the type of salt used in the furnace. Each hole 44 has an axis 46 which is spaced from and is parallel to the longitudinal extending axis 38 of the shank 36. Axes 46 and axis 38 are located in the same horizontal plane. A connecting hole 48 extends laterally into the shank 36 to connect the inner ends of the elongated holes 44 as best illustrated in FIG. 3. A plug 50 (FIG. 3) is located in and closes the outer end of the connecting hole 48. The plug 50 is welded to the shank 36. The elongated holes 44 and the connecting hole 48 form an air cooling passage which has an entrance for the air and an exit or exhaust for the heated air.

The blower, as an example, may be of the type manufactured by The Spencer Turbine Company located at 600 Day Hill Road, Windsor, Conn. 06095 and specifically designated as a Spencer VB-019 Vortex Blower. It has a maximum volume of 160 c.f.m.; a maximum operating vacuum/pressure of 64"/73" of water; a rated vacuum of 50" water at 70 c.f.m.; and a maximum ambient of 40° C. The motor for the blower, as an example, has a voltage of 200–230/460, 3 phase, 60 Hz and a power output of 1.75 KW. The general blower specifications, motor specifications and the performance curves are described in Bulletin 403 of The Spencer Turbine Company. The size of the blower 16 depends upon the number of outlets required.

The header 18 is in the form of an elongated hollow box, conduit or duct made from sheet metal and of generally rectangular cross section. The header 18 extends alongside of and is spaced from furnaces 10, 12. One end of the header 18 is inserted into the discharge end of the blower 16 as schematically illustrated in FIG. 1. The other end of the header 18 is provided with a normally closed bypass valve 52 which permits the air system to be connected to other equipment, not shown, requiring air. The header 18 adjacent the exit of the blower 16 is provided with a conventional pressure switch 54 which sounds an alarm when the pressure in the header 18 goes below a predetermined limit or setting, such as due to blower failure.

Each electrode A, B has the entrance to the air cooling passage connected directly to the header 18. A first conduit 56 is connected on one end directly to the header 18 and on the other end to a hand-operated valve 58. The hand-operated valve 58 is in turn connected by a rubber hose or conduit 60 to the entrance to the air coolant passage of the electrode A, B. The hand operated valve 58 is opened or set at a position which determines the amount of air to be delivered to the electrode A, B when the system 14 is in use. The minimum length of rubber hose 60 to be utilized between the hand valve 58 and the entrance to the electrode A is twelve inches. B has a rubber hose or conduit 62 which exhausts the heated air.

In use, the air cooled electrode system 14 or blower means 16 directs air through the electrode cooling passage (44, 48) to remove heat from the electrode and to direct the heated air to the exit or exhaust. Such system cools a plurality of electrodes simultaneously when located in one or more furnaces. Such an air cooling system saves on installation costs and water when compared with water cooled electrodes.

Figure 4:
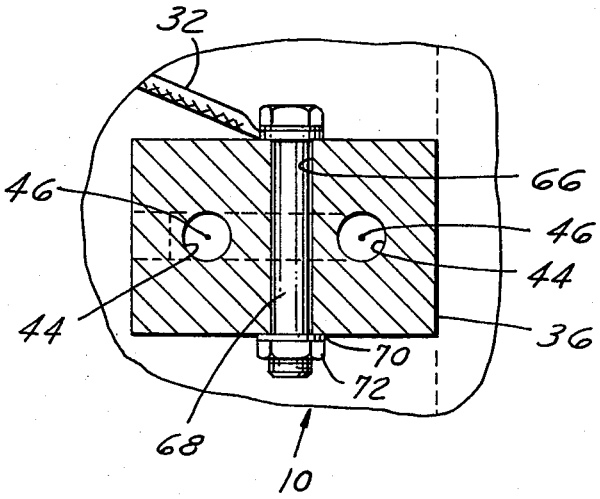
FIG. 4 is a sectional view through one of the electrodes taken on the line 4—4 of FIG. 3.

The outer end of each electrode A, B has a pair of holes 66 extending therethrough for mounting the lead connections 32. As shown in FIG. 4, each lead or electrical conductor 32 is removably secured to the shank 36 by means of an elongated bolt 68 which extends through hole 66 and by a washer 70 and nut 72.

When the chambers 26 are filled with a fused salt or other material for forming the molten bath, electrical current is supplied to the electrodes A and B of furnaces 10 and 12 and the molten material within chambers 26 forms an electrically conductive heating resistor between the electrodes. Thermo-convection will cause a constant circulation of the molten material to maintain a substantially or nearly uniform temperature in the baths of the furnaces 10, 12.

The air cooling system 14 utilizes one common header 18 which supplies the air to the electrodes A, B of furnaces 10, 12 to maintain the electrodes A, B at the proper temperature.

The term "conduit" or "conduit means" include hoses.

What is claimed is:

1. An electrode comprising an elongated shank made from an electrical conductive metal and having a longitudinally extending axis, said shank having in one end thereof a pair of elongated holes which extend into said shank and terminate a distance from the other end of said shank, each hole having an axis which is spaced from and is parallel to said longitudinally extending axis, a connecting hole extending laterally into said said shank to connect the inner ends of said elongated holes, plug means located in and closing the outer end of said connecting hole, said elongated holes and said connecting hole forming an air cooling passage whereby when the electrode is in use air may be directed through said cooling passage to assist in removing heat generated by the electrode.

2. The electrode defined in claim 1 wherein said shank is of rectangular cross-section.

3. The electrode defined in claim 2 wherein a pair of laterally spaced holes extend from one side of said shank to the other and through which fastening devices are adapted to extend to secure lead connections thereto.

4. The electrode defined in claim 2 wherein axes are located in the same plane.

5. In an electrically heated molten salt bath furnace, the combination with a wall enclosing a central chamber for containing the molten salt bath, an electrode laid in a recess extending along a side of said chamber below the surface of the molten salt bath therein so as to expose only one face of the electrode to the molten salt bath, said electrode comprising an elongated shank made from an electrical conductive metal and having a longitudinally extending axis, said shank having in one end thereof a pair of elongated holes which extend into said shank and terminate a distance from the other end of said shank, each hole having an axis which is spaced from and is parallel to said longitudinally extending axis, a connecting hole extending laterally into said shank to connect the inner ends of said elongated holes, plug means located in and closing the outer end of said connecting hole, said elongated holes and said connecting hole forming an air cooling passage which has an entrance and an exit, and blower means connected to the entrance to said cooling passage for directing air through said cooling passage to remove heat from said electrode and to direct the heated air to the exit.

6. In the electrically heated molten bath furnace defined in claim 5 wherein said shank is of rectangular cross-section.

7. In the electrically heated molten bath furnace defined in claim 5 wherein a pair of laterally spaced holes extend from one side of said shank to the other and through which fastening devices extend to secure a pair of lead connections to said shank.

8. In the electrically heated molten salt bath furnace defined in claim 5 wherein there are pair of electrodes of identical construction which extend through said wall into said chamber below the surface of the molten bath, the electrodes being parallel to one another and located in recesses in opposite sides of said chamber, said blower means being connected to the entrance to the cooling passage of each of said electrodes.

9. In the electrically heated molten salt bath furnace defined in claim 5 wherein there are a pair of electrodes of identical construction which extend through said wall into said chamber below the surface of the molten bath, the electrodes being parallel to one another and located in recesses in opposite sides of said chamber, said blower means comprising a blower and a header, said blower being connected to said header for delivering air, and conduit means connecting said header to the entrance to the cooling passage of each of said electrodes.

10. An electrically heated molten salt bath furnace comprising a refractory wall enclosing a central chamber for containing the molten salt bath, an electrode laid in a recess in said wall to extend therethrough into said chamber below the surface of the molten salt bath so as to expose only one face to the molten salt bath, said electrode comprising an elongated shank made from an electrical conductive metal and having a longitudinally extending axis, said shank having in one end thereof a pair of elongated holes which extend into said shank and terminate a distance from the other end of said shank, each hole having an axis which is spaced from and is parallel to said longitudinally extending axis, a connecting hole extending laterally into said shank to connect the inner ends of said elongated holes, plug means located in and closing the outer end of said connecting hole, said elongated holes and said connecting hole forming an air cooling passage which has an entrance and an exit, and blower means connected to the entrance to said cooling passage for directing air through said cooling passage to remove heat from said electrode and to direct the heated air to the exit.

11. The electrically heated molten salt bath furnace defined in claim 10 wherein there are a pair of electrodes of identical construction which extend through said wall into said chamber below the surface of the molten salt bath, the electrodes being parallel to one another and located in recesses in opposite sides of said chamber, said blower means being connected to the entrance to the cooling passage of each of said electrodes.

12. The electrically heated molten salt bath furnace defined in claim 10 wherein there are a pair of electrodes of identical construction which extend through said wall into said chamber below the surface of the molten salt bath, the electrodes being parallel to one another and located in recesses in opposite sides of said chamber, said blower means comprising a blower and a header, said blower being connected to said header for delivering air, and conduit means connecting said header to the entrance to the cooling passage of each of said electrodes.

13. The combination of an electrode air cooling system and a plurality of electrically heated molten salt bath furnaces, each furnace comprising a refractory wall enclosing a central chamber for containing the molten salt bath, electrodes in each furnace laid in recesses located in and extending along the wall of said chamber below the surface of the molten salt bath so as to expose only one face of each electrode to the molten salt bath, said electrodes of each furnace being parallel to one another and located on opposite sides of said chamber, each of said electrodes comprising an elongated shank made from an electrical conductive metal and having a longitudinally extending axis, said shank having in one end thereof a pair of elongated holes which extend into said shank and terminate a distance from the other end of said shank, each hole having an axis which is spaced from and is parallel to said longitudinally extending axis, a connecting hole extending laterally into said shank to connect the inner ends of said elongated holes, plug means located in and closing the outer end of said connecting hole, said elongated holes and said connecting hole forming an air cooling passage which has an entrance and an exit and blower means connected to the entrances to the cooling passages in said electrodes for directing air through the cooling passages to remove heat from said electrodes and to direct the heated air to the exits.

14. The combination defined in claim 13 wherein said blower means comprises a blower and a header, said blower being connected to said header for delivering air, and conduit means connecting said header to the entrances to the cooling passages of said electrodes of each furnace.

* * * * *